US005310206A

United States Patent [19]

Eugler et al.

[11] Patent Number: 5,310,206

[45] Date of Patent: May 10, 1994

[54] SAFETY BINDING

[75] Inventors: Norbert Eugler, Karlsfeld; Werner Schindler, Munich, both of Fed. Rep. of Germany

[73] Assignee: Silvretta-Sherpas Sportartikel GmbH, Karlsfeld, Fed. Rep. of Germany

[21] Appl. No.: 991,963

[22] Filed: Dec. 17, 1992

[30] Foreign Application Priority Data

Dec. 20, 1991 [DE] Fed. Rep. of Germany ..... 4142434

[51] Int. Cl.[5] ..... A63C 9/08

[52] U.S. Cl. ..... 280/615; 280/634

[58] Field of Search ..... 280/614, 615, 611, 618, 280/625, 626, 628, 631, 632, 634

[56] References Cited

U.S. PATENT DOCUMENTS

| | | | |
|---|---|---|---|
| 4,593,927 | 6/1986 | Salomon et al. | 280/615 |
| 4,611,822 | 9/1986 | Bernhardson | 280/615 |
| 5,007,656 | 4/1991 | Girault et al. | 280/615 |
| 5,033,767 | 7/1991 | Provence et al. | 280/615 |

*Primary Examiner*—Richard M. Camby

*Attorney, Agent, or Firm*—Lloyd McAulay; Julius Fisher; J. Harold Nissen

[57] ABSTRACT

The safety binding has a base part which is fixed with respect to the ski, a release part which is supported so as to be rotatable relative to the base part, and a guide jaw with clamping device for clamping the boot sole. In order to support the release part relative to the base part, this release part has at least three guide rolls which are supported so as to be freely rotatable and have circumferential grooves in which guide flanges engage, which guide flanges are downwardly and inwardly bent at the underside of the release part and engage in the guide grooves with their inwardly bent edges. Cut out portions are located between the guide flanges so that the release part can be freed from the guide rolls after a determined rotation relative to the base part. A release cam having a central locking recess and two symmetrically arranged control cams is securely connected with the release part. A control roll which is displaceable against the action of springs of a release mechanism engages in the locking recess in the operating position and rolls at one of the control cams during the releasing process.

6 Claims, 2 Drawing Sheets

SAFETY BINDING

BACKGROUND OF THE INVENTION

1. Field of the Invention

The invention is directed to a safety binding for a boot holding device in which the heel can be lifted, in which the boot is held in the binding at its front sole part by means of a clamping device which can be actuated at will, the binding being constructed in two parts and having a base part which is fixed with respect to the ski and a release part which is detachable from the base part during overloading by means of rotation relative to the base part and is held at the base part in the operating position by means of a release mechanism.

2. Background Art

Bindings of this type can be used for long-distance skiing, tour skiing, skiing corresponding to the recently revived telemark style, and for ski jumping. In these ski disciplines the skier must be able to lift the heel from the ski. While safety bindings for long-distance skiing, for example, are already known, no such safety bindings exist for ski jumping. This sometimes results in severe injuries in falls from th ski jump.

In a known binding of the type mentioned in alone (DE-A-33 10 739), the sole of the boot which is lengthened toward the front is fixed by means of a plug-in pin at the upper binding part which is constructed as a plate. This upper binding part which is constructed as a plate extends to the vicinity of the boot heel and is supported so as to be swivelable approximately in the center by means of a trunnion which is fixed with respect to the ski. The plate has an elongated hole through which the headless trunnion engages, so that the plate can free itself from the ski together with the shoe after the releasing process. The plate is secured against lifting in the rear area by a bracket which overlaps the plate and is supported toward the front against a spring-mounted release pin which is arranged on the ski very far in front of the shoe because of the necessary holding device for the sole which projects forward.

This construction results in various disadvantages. A significant disadvantage consists in that the release part which is detachable from the ski by means of rotation must be mechanism, which includes a spring-mounted pin, requires that the release part be supported at a certain distance in the lateral direction. In the known binding, the lateral support is effected by the rotating trunnion on which the plate is supported so as to be rotatable. This relatively large dimensioning of the plate, which is compulsory, results in an additional weight load on the one hand and in the risk of ice formation between the plate and the ski on the other hand, which substantially impairs the releasing process. Another substantial disadvantage consists in that the release pin and the locking opening in the plate are located very far in front of the boot, resulting in large differences in the releasing behavior depending on whether the boot rests on the ski or the heel of the boot is lifted. In order to counter this disadvantage a variant of the known binding discussed in the beginning provides a twofold arrangement of release parts. That is, an additional release system in the form of a shorter plate is provided on the release plate, both of them cooperating with spring-mounted locking balls. This construction not only adds considerable weight, but also results in a disproportionately higher construction cost because of the two release systems. Moreover, it is not possible to free the boot from the ski in this construction since the release parts are connected with the ski in a fixed manner.

OBJECT AND SUMMARY OF THE INVENTION

The primary object of the present invention is to provide a safety binding, for the types of sport mentioned above, which has a low weight and favorable releasing characteristics with different foot positions and which is not susceptible to icing.

In accordance with the invention, a safety binding for a boot holding device is provided in which the heel can be lifted, in which the boot is held in the binding at its front sole part by means of a clamping device which can be actuated at will, the binding being constructed in two parts and having a base part which is fixed with respect to the ski and a release part which is detachable from the base part and is held at the base part in the operating position be means of a release mechanism. The improvement comprises that the base part has at least three guide rolls which are supported so as to be freely rotatable and provided with circumferential grooves for guiding the release part, that the base part further has an adjustable release mechanism with spring loaded release member, that the release part has a rotating plate with a number of downwardly and inwardly bent guide flanges corresponding to the number of guide rolls for engaging in the circumferential grooves of the guide rolls as well as a number of recesses between the guide flanges likewise corresponding to the number of guide rolls and that the release part further has a release cam with control cams for the releasing process which cooperated with the releasing member of the base part.

This construction enables a compact, lightweight safety binding which can be used on any ski and which must ensure that the boot heel can be lifted freely. Another substantial feature of this construction consists in the fact that it not only enables a rotating movement of the boot relative to the ski, but the boot can also be completely detached from the ski after reaching a determined angle of rotation as a result of the arrangement of cut out portions in the guide flange. Since the guide jaw is arranged so as to be fixed at the boot together with the release part by means of the clamping device, it is possible to fasten the boot to the ski again easily after a fall. Since the release part overlaps the base part and the guide rolls and moreover since it engages in the circumferential grooves of the guide rolls with inwardly bent flanges and accordingly also overlaps the release mechanism which is substantially arranged in the base part, the risk of icing and blocking of the safety binding is practically ruled out, especially since the rotation of the release part relative to the base part cannot be blocked by ice because the flanges can be constructed so as to be relatively thin and accordingly like cutting edges so that snow can be displaced by the guide flanges by a rotating movement even in the event that snow penetrates under the release part.

Since the guide rolls are supported by means of roller bearings in a further development of the invention an extreme ease of movement is ensured so as to prevent influence on the releasing process.

The radial or control cams in the release cam are preferably constructed so as to be symmetrical to the longitudinal axis and define a central locking recess for the releasing member. This results in a uniform releasing process in both rotating directions so that there is no left or right binding and the skis are accordingly interchangeable.

In order to prevent friction processes from negatively influencing the releasing process, the releasing member is advantageously constructed as a control roll in a further development of the invention. Accordingly, a rolling process takes place at the control cams rather than sliding friction.

In order to clamp the boot at the release part a construction is recommended which is characterized in that the clamping device includes a U-shaped guide jaw for the boot sole, which guide jaw is fastened with its base at the release part. A clamping shaft which is rotatable by means of a lever is rotatably supported at both sides of the legs of the guide jaw which are arranged vertically relative to the surface of the ski. The clamping shaft is flattened between the legs by means of a recessed portion extending at least to the center of the shaft, the curved portion of the clamping shaft engaging in an adapted flute in the overlapping boot sole in the clamping position. Accordingly, a clamping device is provided which is easy to operate and has a particularly simple and lightweight construction. In addition, this clamping device has the advantage that the sole of the boot is drawn into and accordingly tightly clamped in the guide jaw by the segment-like construction of the clamping shaft which engages in the flute of the boot sole when rotated so that the boot sole is wedged into the guide jaw, which improves the lateral support of the boot in the guide jaw.

The support of the boot sole in the guide jaw is improved according to another construction of the invention in that the two legs are at least partially bent inward at their free upper edges and the distance of the free edges from the base part of the guide jaw is substantially adapted to the thickness of th boot sole. The jump-off forces acting substantially vertically relative to the ski surface when jumping off a ski jump can accordingly be safely absorbed without the position of the boot being changed relative to the guide jaw.

The invention is explained in more detail in the following with the aid of embodiment examples shown in the drawing.

DESCRIPTION OF THE PREFERRED EMBODIMENTS

Figure 1:
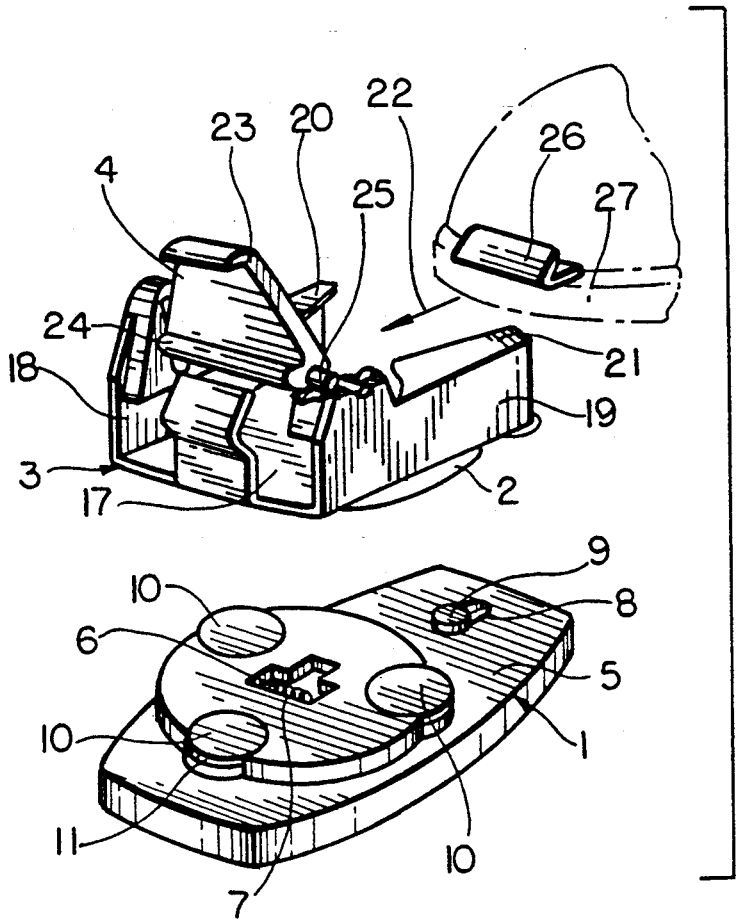
FIG. 1 shows a front safety binding including a base part, release part, and guide jaw with a clamping device.
Figure 2:
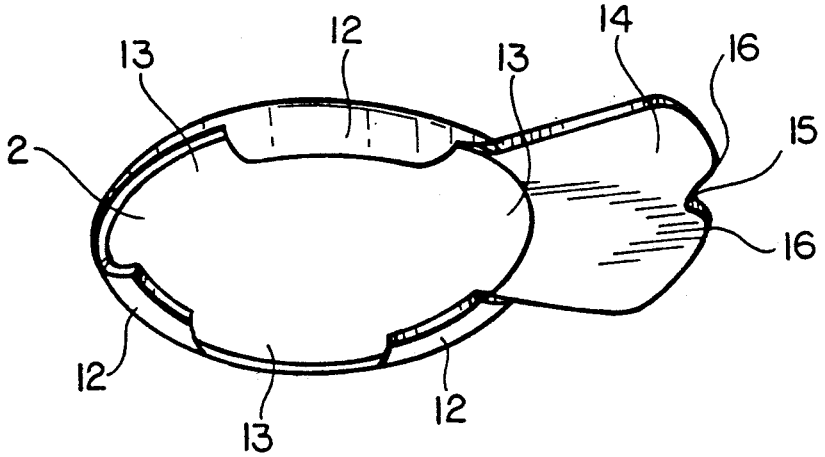
FIG. 2 shows the release part as viewed from below.
Figure 3:
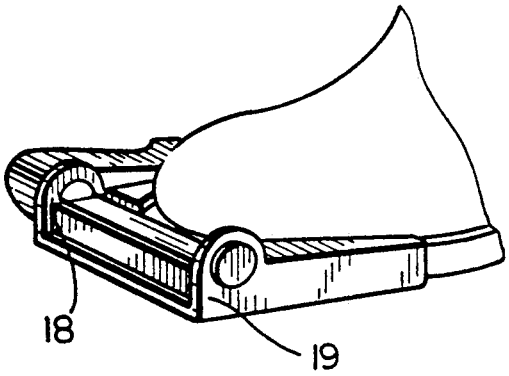
FIG. 3 shows a view of a guide jaw with a clamping device and a clamped boot.
Figure 4:
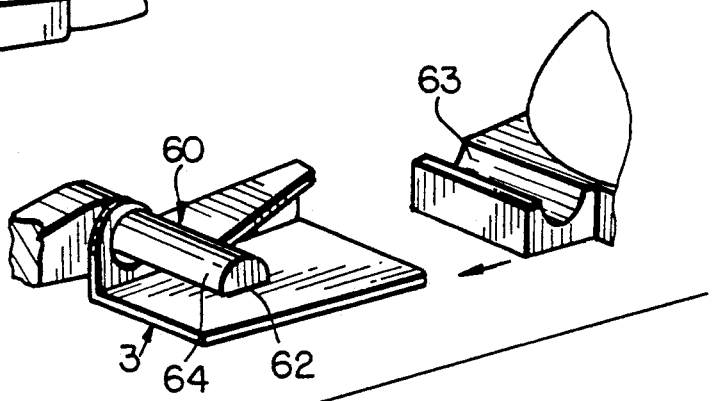
FIG. 4 shows a longitudinal section through the guide jaw with the clamping device and a boot which is to be inserted.

As shown in FIGS. 1 and 2, the front safety binding includes a base part 1 which can be fastened to a ski, not shown, a release part z, and a guide jaw 3 with clamping device 4, which guide jaw 3 is fastened on the release part.

The base part 1 includes a housing 5 in which a release mechanism is accommodated. This release mechanism includes a spring package having a plurality of springs 6 which are supported on the one hand against a stop, not shown in the drawing, which is adjustable by a screw 7 and on the other hand against a movable slide, likewise not shown in the drawing, which carries a control roll 9 projecting out through a slot s of the housing 5. Further, three guide rolls 10 are supported on the housing 5 so as to be freely rotatable and are provided with circumferential grooves 11. The guide rolls are arranged at equidistant intervals with their rotational axes, not shown, on a circle and serve to support the release part 2 in a rotatable manner. This release part 2 has at its circumference a number of downwardly and inwardly bent guide flanges 12 corresponding to the number of guide rolls 10. A number of recesses 13 Which likewise corresponds to the number of guide rolls are defined between the guide flanges 12. The guide flanges 12 engage in the circumferential grooves 11 with their inwardly bent edges so that the release part 2 is rotatably supported by the guide rolls 10. The arrangement of the guide flanges 12 is effected in such a way that the guide rolls 10 lie in the center of the respective guide flanges 12 in the operating position When the release part 2 is rotated by an amount corresponding to half the circumferential path of the respective guide flanges 12, these guide flanges 12 exit from the circumferential grooves and the guide rolls arrive in the region of the recesses 13 so that the release part 2 is released from the guide rolls 10 and accordingly freed from the base part 1.

A release cam 14 having a central locking recess 15 at its free end and symmetrically constructed control cams 16 adjoining the latter is securely connected with the release part 2. In the operating position, the control roll 9 engages in the locking recess 15. The control cams 16 adjoining the locking recess 15 first cause a resistance against a rotation of the release part 2 due to their shape. Since the control roll 9 lies in the locking recess 15 in the operating position, a rotation of the release part 2 is only possible when the control roll 9 which rolls at one of the control cams 16 during this rotating movement is displaced in its elongated hole 8 against the resistance of the springs 6. The release rigidity can accordingly be fixed depending on the adjustment of the adjustable stop.

The guide jaw 3 provided o the release part 2 is substantially U-shaped and has a base 17 as well as two vertically upright legs 18 and 19 Whose free edges 20 and 21 are bent inward and are situated at a distance from the base 17 substantially corresponding to the thickness of the boot sole so that the latter after insertion in the direction of the arrow 22, is held in the lateral direction by the legs 18, 19 as well as at the top by the edges 20, 21. The clamping device 4 Which is constructed as an angled two-armed lever 23, 24 and is swivelably supported in the legs 18, 19 by means of a plug-in shaft 25 is provided so that the boot cannot slip out toward the rear, that is, opposite the direction of the arrow 22. When inserting the boot into the guide jaw, the clamping device 4 is first swiveled in such a way that the lever 23 faces forward and downward so that a v-shaped mounting 26 which is open toward the rear can slide on the upper side of the boot sole 27 under the short lever 24. The lever 24 hooks securely into the mounting 26 when the clamping device 4 is swiveled up.

An embodiment of the clamping device for fastening the boot in the safety binding is shown in FIGS. 3 to 6. This embodiment form which is modified relative to FIG. 1 is viewed as the preferred embodiment form.

Figure 5:
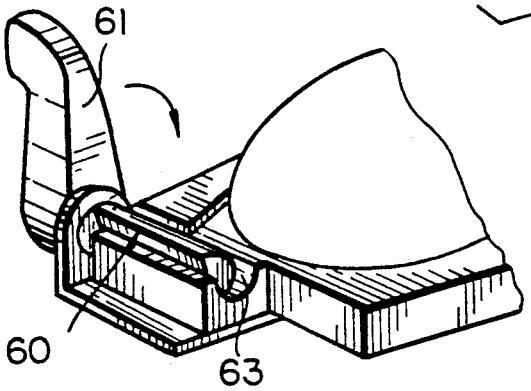
FIG. 5 shows a longitudinal section through a guide jaw with a clamping device and a boot during the clamping process.
Figure 6:
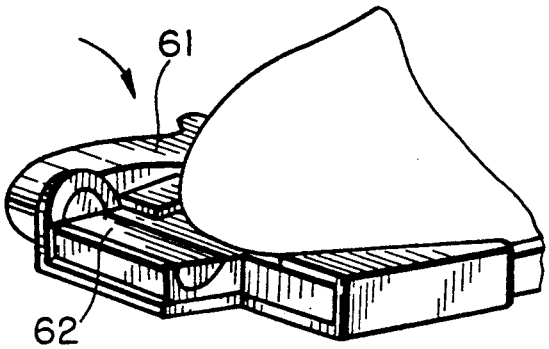
FIG. 6 shows a longitudinal section through a guide jaw with a clamping device and boot in the clamped state.

In this embodiment, the guide jaw corresponds to that in FIG. 1 and is therefore provided with the same reference number. The clamping device includes a clamping shaft 60 which is rotatably supported at both sides in the legs 18 and 19 of the guide jaw 3 and is rotatable by means of a lever 61 which is arranged at one end of the clamping shaft 60. The clamping shaft has a recessed portion which extends at least to its center, leaving a segment-like flattened portion 62. The front end of the boot sole has a flute-like recess 63 extending along the entire width of the sole and adapted in shape to the rounded portion 64 of the clamping shaft 60. The lever is swiveled forward to clamp the ski boot so that the flattened portion 62 faces downward as shown in FIG. 10. The tip of the boot can accordingly be slid under the clamping shaft. The lever 61 is then swiveled and the clamping shaft 60 is accordingly rotated and engages in the groove 63 as shown in FIG. 5. The final state is shown in FIG. 6, wherein the lever 61 is swiveled back completely and the rounded portion 64 of the clamping shaft 6 engages in the groove 63 in a positive-locking manner.

What is claimed is:

1. In a safety binding for a boot holding deice in which the heel can be lifted, in which the boot is held in the binding at its front sole part by means of a clamping device which can be actuated at will, the binding being constructed in two parts and having a base part which is fixed with respect to the ski and a release part which is detachable from the base part during overloading by means of rotation relative to the base part and is held at the base part in the operating position by means of a release mechanism, the improvement comprising that the base part has at least three guide rolls which are supported so as to be freely rotatable and provided with circumferential grooves for guiding the release part, that the base part further has an adjustable release mechanism with springloaded releasing member, that the release part has a rotating plate with a number of downwardly and inwardly bent guide flanges corresponding to the number of guide rolls for engaging in the circumferential grooves of the guide rolls as well as a number of recesses between the guide flanges likewise corresponding to the number of guide rolls, and that the release part further has a release cam with control cams for the releasing process which cooperate with the releasing member of the base part.

2. Safety binding according to claim 1, wherein the guide rolls are supported by means of roller bearings.

3. Safety binding according to claim 1 or 2, wherein the control cams at the release cam are constructed so as to be symmetrical to the longitudinal axis of the ski and define a central locking recess for the releasing member.

4. Safety binding according to claim 1 or 2 wherein the releasing member is constructed as a control roll.

5. Safety binding according to claim 1 or 2 wherein the clamping device includes a U-shaped guide jaw for the boot sole, which U-shaped guide jaw is fastened by its base at the release part, a clamping shaft which is rotatable by means of a lever being rotatably supported at both sides at the legs of the guide jaw which are arranged vertically relative to the surface of the ski, which clamping shaft is flattened between the legs by a recessed portion extending at least to the center of the shaft, a curved portion of the clamping shaft engaging in an adapted flute in the overlapping boot sole in the clamping position.

6. Safety binding according to claim 5, wherein the two legs are at least partially bent inward at their free upper edges, wherein the distance of the free edges from the base part of the guide jaw is adapted substantially to the thickness of the boot sole.

* * * * *